United States Patent [19]

Reis

[11] 3,954,674

[45] May 4, 1976

[54] PROCESS AND DEVICE FOR CALCINATING DESULFURIZATION OF GREEN COKES WITH HIGH SULFUR CONTENT BY THE PREPARATION OF HIGH QUALITY AND DENSITY DESULFURIZED COKES

[76] Inventor: Thomas Reis, 4 Villa de Madrid, 92 Neuilly, France

[22] Filed: Dec. 26, 1973

[21] Appl. No.: 427,437

[30] Foreign Application Priority Data

| | | |
|---|---|---|
| Jan. 26, 1973 | France | 73.02723 |
| Oct. 12, 1973 | France | 73.36620 |
| Jan. 26, 1973 | France | 73.02724 |
| Oct. 12, 1973 | France | 73.36619 |

[52] U.S. Cl. ..... 252/502; 23/232 R; 201/1; 201/17; 423/461

[51] Int. Cl.[2] ..... H01B 1/04

[58] Field of Search ..... 252/502; 201/1, 17; 423/461; 23/230 A, 232 R

[56] References Cited

UNITED STATES PATENTS

| | | | |
|---|---|---|---|
| 3,369,871 | 2/1968 | Hardy et al. | 201/17 X |
| 3,684,446 | 8/1972 | Markel | 423/461 X |

OTHER PUBLICATIONS

Chemical Abstracts 67, 13617q (1967), ""Desulfurizing of Petroleum Coke."

Chemical Abstracts 66, 39528r (1967), "Laboratory Continuous Process of Thermal Desulfinization of Petroleum Cokes in a Fluidized Bed."

*Primary Examiner*—Benjamin R. Padgett
*Assistant Examiner*—E. Suzanne Parr
*Attorney, Agent, or Firm*—Millen, Raptes & White

[57] ABSTRACT

This invention relates to a process for the simultaneous desulfurization and calcination of "green coke."

15 Claims, 14 Drawing Figures

PROCESS AND DEVICE FOR CALCINATING DESULFURIZATION OF GREEN COKES WITH HIGH SULFUR CONTENT BY THE PREPARATION OF HIGH QUALITY AND DENSITY DESULFURIZED COKES

It is old to calcine oil coke by heating green coke in furnaces at suitable temperatures. For example, furnaces have been described in which the green coke is brought to temperature on the order of 1,200° to 1,350°C, to obtain a product of practically amorphous structure (Green coke is the term used for oil coke resulting from delayed coking of oil residues, sometimes rich in sulfur).

It is known further that, in certain uses of oil coke, for making electrodes for instance, it is necessary that said coke contain only small quantities of sulfur, 1.2% maximum and preferably 1% maximum. This requirement has led technicians until now to use for the preparation of green coke for electrode applications only residues having a very low sulfur content, i.e., less than the maximum sulfur quantities allowable in the coke obtained. In fact, the green coke calcination processes used heretofore did not allow simultaneous calcination proper together with the desulfurization of green coke.

The present invention concerns a process permitting this problem to be solved specifically the preparation from a sulfurrich green coke of an oil coke having a sufficiently low sulfur content for the use of said oil coke as raw material for electrodes.

By a sulfur-rich green coke is meant a green coke having sulfur content higher than the maximum sulfur content in the final coke for electrode preparation. Since the allowable sulfur content in coke is 1.2% maximum, one can use, according to the process, green coke having a higher sulfur content, equalling for instance 3 to 6% by weight.

The invention described in the present application is based on the following facts:

The sulfur may be found in green cokes under very diverse forms. However, it has been noted that in green cokes poor in sulfur (1% for instance), said sulfur is in the form of relatively thermally stable organo-sulfurized compounds, which decompose only at very high temperatures, e.g. above 1,800°C. On the other hand, in sulfur-rich cokes, a very large part of the sulfur is in the form of organo-sulfurized compounds which are less stable thermally and which can therefore be eliminated at much lower temperatures, as will be seen further.

Furthermore, to eliminate these thermally less stable organo-sulfurized compounds, it is necessary to raise the oil residues to a temperature generally higher than that used during a non-desulfurizing calcination and such that there is caused the beginning of coke crystallization (or graphitization) phenomenon. In fact, it has been found that it is during this phenomenon of coke crystallization, a phenomenon leading to a through rearrangement of the molecules, that the sulfurized compounds may be liberated and escape from the coke. However, this crystallization phenomenon must be effected sufficiently slowly to permit this liberation under such operating conditions that preferentially open pores are formed in the coke.

Since the coke crystallization phenomenon must be relatively slow, this implies that the time while the green coke remains in the furnace must be rather long (longer than that normally practiced in the actual production of cokes). Now, it may happen that, for certain throughputs, one might have to modify the operating conditions in the furnace to obtain the result sought and, since the residue time is long, this may lead to large losses of raw materials and unusable cokes. This is why, according to the process of the present invention, it is highly desirable that a certain number of controls are effected on the coke during treatment. The present application also concerns, therefore, the selected processes which are usable during desulfurizing calcination to control coke and sulfur evolution.

The temperature at which the desulfurizing calcination of green cokes must be done according to the present invention depends, to a certain extent, on the kind and composition of these green cokes. To determine the temperature zone to be used, one may, theoretically, use the curves of the real density (dr in gr./c.c.) of the cokes obtained as a function of the calcination temperature in °C, for a given calcination time. If the curves are plotted with the real density as the ordinate and with calcination temperature as the abscissa, between 1,000° and 2,500°C, it is noted that said curves present, for an increasing abscissa, a portion where the density increases, a maximum followed by a portion where the density decreases, then a minimum followed by a portion where the density increases anew. The desulfurizing calcination temperature according to the present invention is chosen from among temperatures corresponding to the decreasing portion of the curve or, possibly for high sulfur cokes, near the minimum of said curve. It has been noted that, in general, these temperatures were higher than 1,400°C.

As stated beforehand, the duration of the desulfurizing calcination duration should be longer than the calcination which was practiced until now. This has been on the order of 1 to 4 hours. It is desirable, according to the present invention, that this calcination duration, all other things being equal, be higher.

Therefore, the present invention concerns a desulfurizing calcination process of sulfurized cokes in order to prepare desulfurized cokes usable, in particular, for electrode production, characterized in that said calcination is effected at a temperature of between 1,400° and 1,700°C for a duration higher than that required by a simple calcination, said calcination being effected in reducing atmosphere with control of coke during processing.

This control concerns the following basic points:

coke sulfur content progress of coke graphitization.

pore structure and coke density.

These various measurements are done industrially and continuously on the installation during the treatment by taking coke samplings at various stages, i.e., by measurement in place on the hearth itself.

As for sulfur content, one of the following methods may be used:

continuous analysis of flue gas output and of flue gas composition in gaseous sulfurized products: $SO_2$ and $H_2S$. Since, in the installation according to the invention, the output of products entering into the furnace and the sulfur content of said products are known, it is easy to obtain by these measurements, a comparative idea of the residual sulfur content of the coke being treated;

a coke sampling and determination of the sulfur content of said sample by a method involving gamma or X-rays. Such a method (Gamma-ray or X-ray analysis)

is in itself well known. However it is being used for the first time within the context of the present invention for continuous determination of sulfur in the coke being desulfurized. For instance, one activates some coke powder by gamma rays, which causes a fluorescence detected and measured by amplified scintillation, the source being Americum 241. The measuring accuracy is ± 100 ppm of sulfur in the coke.

In so far as graphitization progress is concerned, the control is effected industrially and continuously, through X-ray diffraction analysis on the continuously taken samples. There will be noted after this measurement, on the one hand the appearance of X-ray diffraction characteristics of the crystallites in progress of formation and, on the other, the dimensions of the crystallites formed.

As for the coke pore structure and the content in impurities (metal oxides), the following measurements in place can be made: a coke resistivity measurement by the determination of electric resistance between two electrodes immersed in the coke bed. This measurement is known in itself. Obviously, several pairs of electrodes may be used, switched around at will to test the coke at various points of the furnace;

a coke density measurement through passage of gamma or X-rays in the bed of the coke being formed.

These various measurements, which are very important within the context of the present invention, may obviously be added to and checked if necessary by laboratory measurements on the samples taken. Among these additional measurements, the following determinations may be noted:

coke particle size distribution coke porosity, which determines the kind of pores (open or closed) and their distribution In addition, the following additional original measuring methods have been developed:

coke paramagnetic resonance (linked to electric resistivity)

coke pH value (linked to products superficially adsorbed on the coke)

the mechanical characteristics of the coke, for instance its stress relaxation (variation of compressive stress value for an invariable deformation, expressed in % of the maximum pressure)

the densities, by pycnometer the specific surfaces (BET surface, by adsorption of liquid with gaseous diffusion or by electron microscopy) of the coke Coke reactivities Some of the laboratory methods described above have been developed so that they may be systematized in or near industrial installations. This is the case, in particular, for measurements of paramagnetic resonance linked to the electric resistivity of the coke and for pH measurements, linked to the kind and quantity of the products superficially adsorbed in the coke.

There has also been developed an automatic treatment system of coke samples giving, in particular, immediate knowledge of sulfur content in the coke and of coke density.

The coke treated according to the invention may be advantageously impregnated with pitch before treatment. Such an impregnation, which may be total or partial, presents the following advantages:

pitch combustion leads to formation of carbon, this combustion causes a homogenization of the temperature inside each coke grain this combustion produces a neutral and reducing atmosphere, which is favorable to desulfurizing calcination according to the invention.

As impregnation substance, one chooses preferably a pitch of polyaromatic or polycyclic composition, i.e., rich in carbon. Obviously, this pitch should be free of sulfur.

One may also add to the treated products, elements acting on coke graphitization. Along these elements, one may cite:

slowing-down agents like $O_2$, S, Cr, Se, Mo or accelerators like C, Si, Al, Ni, Ca, Ti.

The desulfurizing calcination according to the present invention may be used in furnaces of very diverse types, like rotary furnaces or inclined-hearth furnaces. Obvisouly, taking into account the controls noted above and effected during said calcination, the experimental conditions within the furnace may be totally and/or locally adapted to coke treatment, so as to conduct this treatment under optimum conditions.

In particular, it is desirable to see that all the particles of the coke being produced are subjected to the same conditions. To achieve this, the coke bed should be preferably subjected to a suitable system of mechanical homogeneization. In the rotary hearth furnaces, there has been found, according to the present invention, a particularly effective homogeneization system, consisting of a Wormscrew placed radially into the suitably cooled furnace, scraping the surface of the hearth and causing a displacement of coke particles both vertically and horizontally. This device is particularly interesting for inclined-hearth furnaces since through suitable choice of wormscrew pitch and of wormscrew rotation speed one can control perfectly the displacement of coke particles on the hearth and in the bed. The use of such a device, combined with a system of coke bed height adjustment, is equivalent to an inclined-hearth furnace of which the hearth inclination angle is varied at will.

The coke bed height adjustment system may be effected preferably when the raw coke is introduced on the hearth, by means of a simple tube inserted into the furnace up to a suitable distance and adjustable from the hearth of said furnace.

The invention may be better understood by means of a certain number of figures, concerning the process on the one hand and the devices described on the other:

FIG. 1 shows the variation of real density (dr) of slightly sulfurized cokes treated at 1,350°C during variable durations (1 to 6 hours). The three curves correspond respectively to cokes with the following particle size distribution:

curve 1: 60 mesh
curve 2: 100 mesh
curve 3: 200 mesh

It is seen on this figure, which represents treatment of coke according to the old techniques, that the real density of the coke evolves only very slowly with time after about 2 to 3 hours of treatment. This explains why, in the prior art processes, the treatment time is generally 1 to 2 or 3 hours.

FIG. 2 gives the real density (dr) of a coke subjected to calcination for a given time (5 hours) in function of the calcination temperature (T°C).

The curves given on this figure refer respectively:

1. to an oil coke coming from the residue of cracking of an oil poor in sulfur (about 0.8%).

2. to an oil coke coming from cracking residue of an oilrich sulfur (about 4%)

3. to a pyrolysis coke 4. to a coke from a Middle-East oil residue with high sulfur content (about 5%).

One can see on these curves the temperatures usable according to the present invention: for curve 2 coke, one uses a temperature higher than 1,450°C (maximum value) and, preferably a temperature on the order of 1,500° to 1,700°C; for curve 4 coke, one uses a temperature higher than approximately 1,200°C and, preferably, considering its richness in sulfur, on the order of 1,350° to 1,600°C.

FIG. 3 shows the variations of sulfur content (5%) of calcined sulfurized cokes during 5 hours at variable temperatures (T°C). Curves 1,2,3 and 4 refer respectively:

1. to an oil coke residue within initial sulfur content of about 3.7%

2. to a sulfurized green coke with initial sulfur content of 3.6%

3 and 4 to low sulfurized cokes.

This figure shows clearly that, to obtain a final coke with low sulfur content, from sulfurized green cokes, operations must be effected at high temperatures (about 1,500°C so that the sulfur content becomes less than 1.2%). It may be seen also on this figure that the sulfur elimination method differs depending on whether one uses as initial product a coke poor in sulfur (1%) or a coke rich in sulfur (about 3.6%).

FIG. 4 shows analogous curves prepared on the bais of highly sulfurized raw cokes. On this figure, the various curves refer to:

1 a green coke with inital sulfur content of 5.3%

2 another green coke with 4.9% in S

3 another green coke with 4.3% in S

4 another green coke with 4% in S

5 another green coke with 3.3 in S

6 a coke from oil cracking residue, 3.8% in S

7 a green coke from Middle-East oil with very high sulfur content.

These curves show that all cokes with high sulfur content may be treated according to the invention and that, taking into account the chosen calcination time, the temperature to be used for sufficient desulfurization (less than 1.2% in S) falls between 1,350° and 1,500°C.

FIG. 5 shows the sulfur content (%S) of various sulfurized cokes (sulfur content variable from about 3 to about 5.5%) in function of time (t*t* in hours) for two calcination temperatures: 1,350° and 1,550°C.

The curves in dotted lines are those made at 1,350°C and those in solid lines at 1,550°C.

It may be seen that, to obtain sufficient product desulfurization, the calcination time should be sufficiently long (at least 4 hours).

FIG. 6 shows the electrical resistance ($\rho$ in ohm,sq.mm./m.) at different temperatures (T°C from 0 to 600°C) for cokes having been subjected to a desulfurizing calcination at various temperatures (from 1,000° to 2,500°C). For these tests, the treated coke had initial sulfur content of about 4%, an ash content of 0.8% and a mean particle size distribution between 0.4 and 0.5 mm.

FIG. 7 shows the electric resistivity ($\rho$ ohm.sq.mm./m.) of a coke ash content 0.8%, initial sulfur content 4% and a mean particle size distribution between 0.4 and 0.5 mm. heated to 600°C, having been subjected to a desulfurizing calcination at various temperatures (T°C)

FIGS. 8 and 9 show the properties of various cokes after calcination:

FIG. 8 shows the mechanical stress relaxation (R%) in function of the specific pressure (P in kg./sq.cm.) for various cokes obtained according to the process. It is seen on this figure that the coke particle size distribution has a certain influence on said mechanical stress relaxation. The various curves have been plotted respectively:

| | | |
|---|---|---|
| 1 coke of mean particle size distribution | less than | 0.5 mm. |
| 2 coke of " | between | 0.5 and 1 mm. |
| 3 | | 1 and 1.5 mm. |
| 4 | | 1.5 and 2 mm. |
| 5 | higher than | 2 mm. |

FIG. 9 shows the solidity coefficient (C in kg./sq.cm.) of three cokes, in function of pressure (P in kg./sq.cm.) for cokes having been subjected to the desulfurizing calcination process according to the invention. On this figure, the curves 1, 2 and 3 refer respectively to:

| | | |
|---|---|---|
| 1 coke | of mean particle size distribution between | 0.5 and 1 mm. |
| 2 coke | " | 1 and 1.5 mm. |
| 3 | " | 1.5 and 2 mm. |

at 1 the inclined rotary hearth at 2 the crown of the furnace at 4 the wormscrew rotating about a hollow shaft 3, cooled by water circulation and driven by a motor 5.

One should note the shape of the peripheral part of the screw. This shape ensures for the coke particles of the bed a regular mixing, with displacement of said particles both parallel to the hearth and perpendicular to it.

Figure 2:
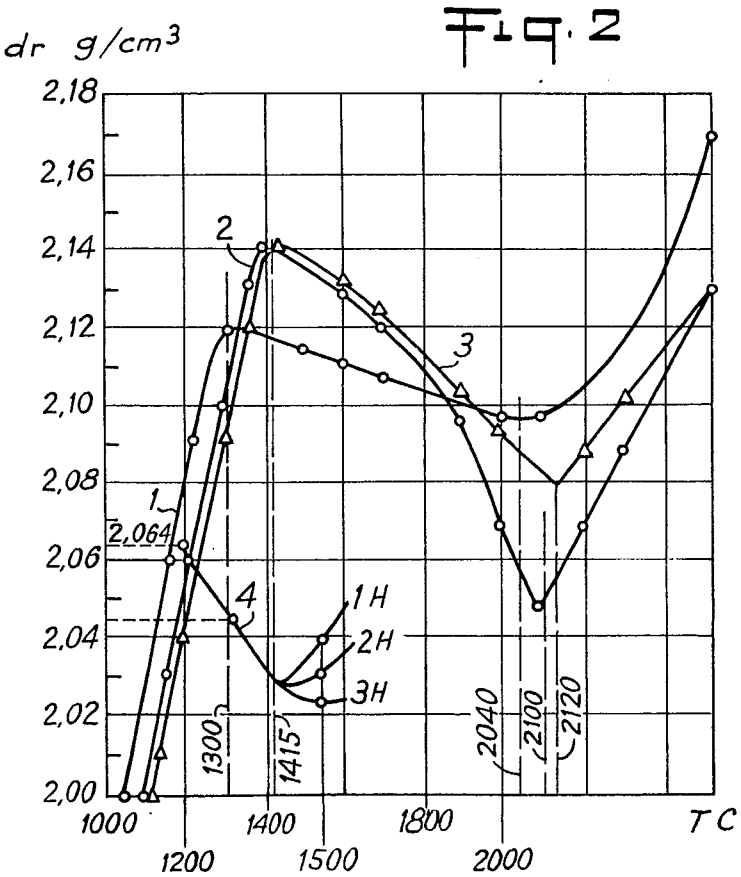
Figure 1:
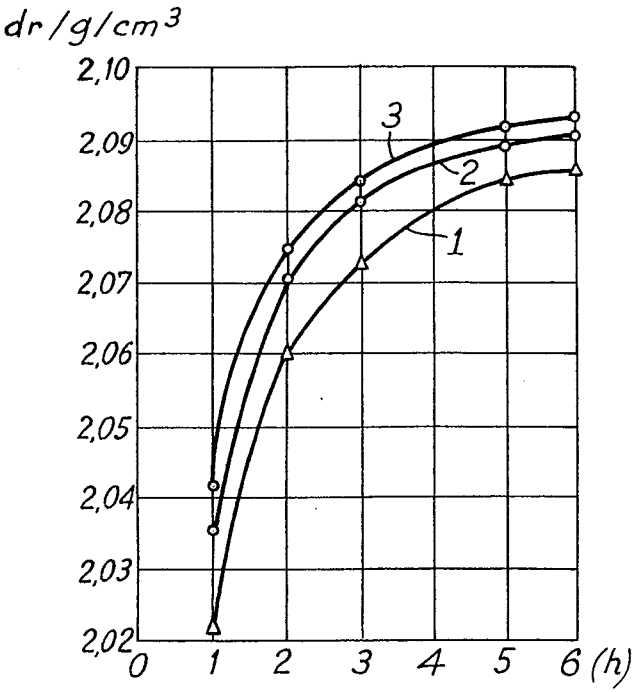
Figure 4:
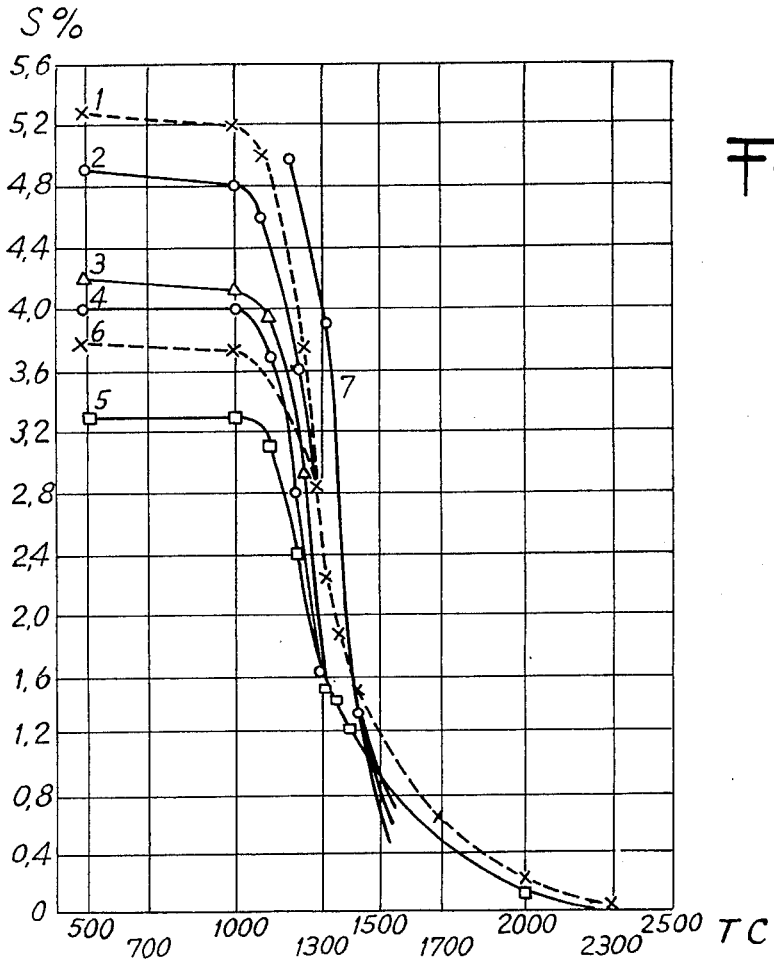
Figure 3:
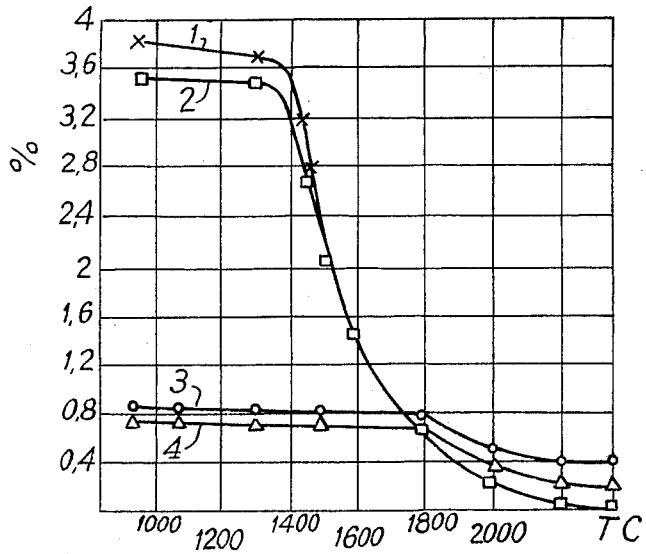
Figure 6:
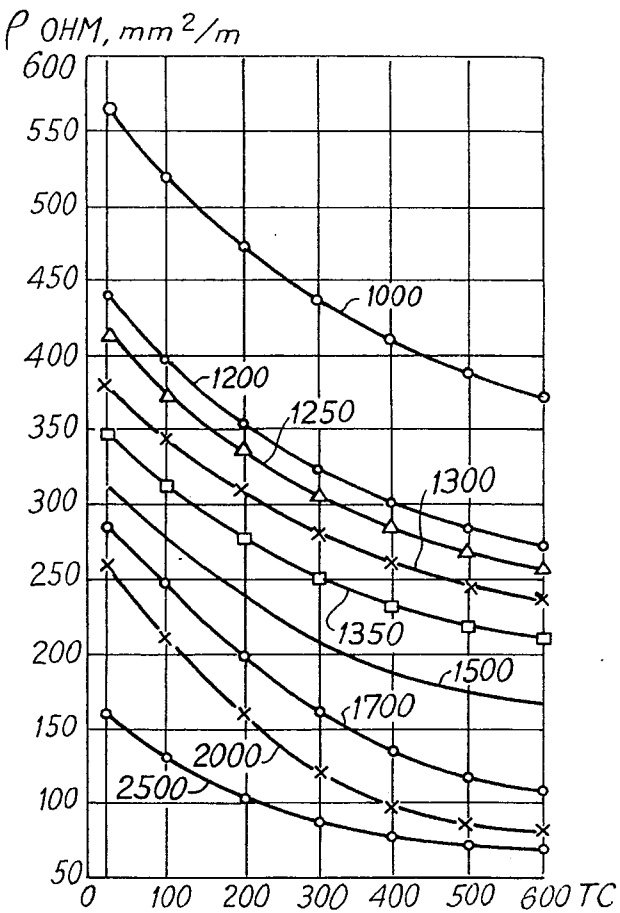
Figure 5:
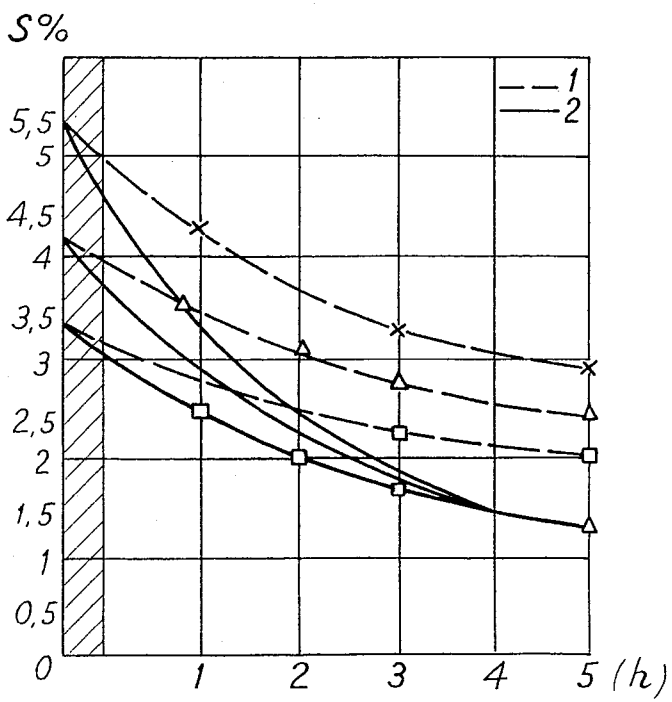
Figure 7:
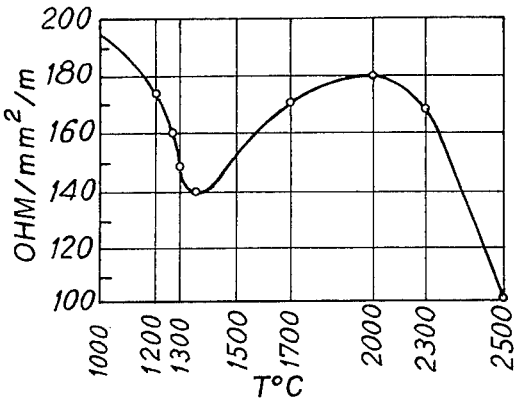
Figure 8:
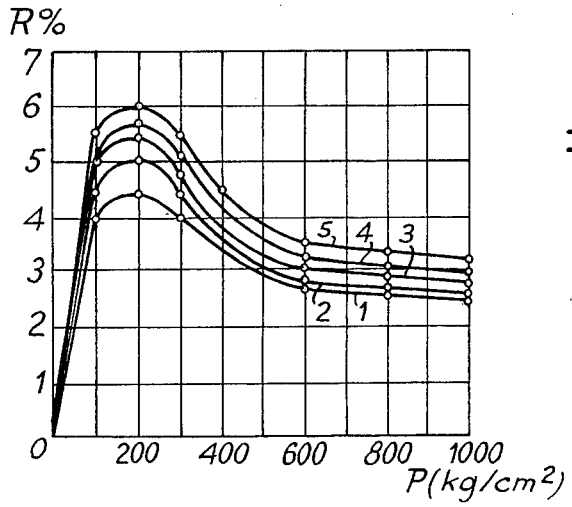
Figure 9:
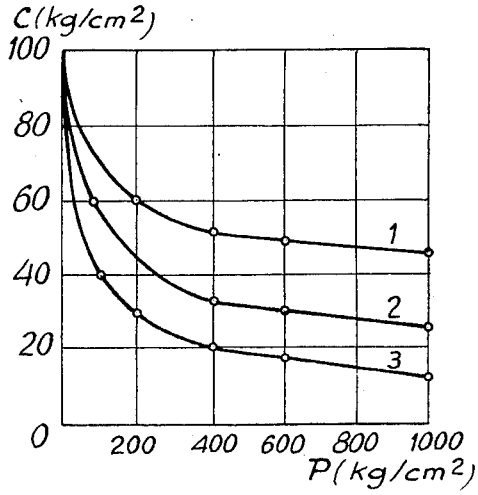
Figure 10:
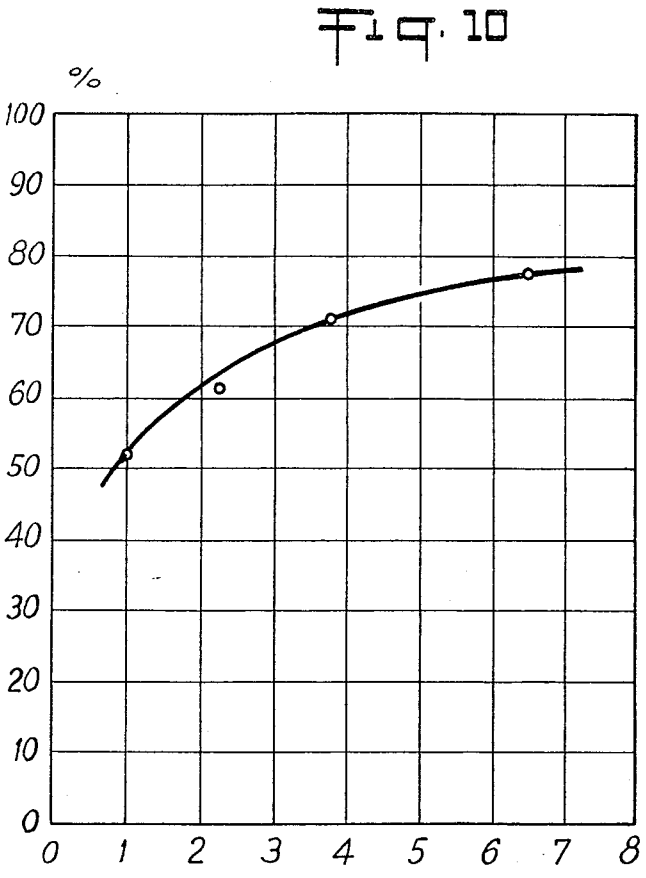
FIG. 10 shows the % of sulfur eliminated from a green oil coke with high sulfur content when said coke has been treated according to the invention in a reducing atmosphere with pressure varying from 1 to 7 atmospheres. The % of eliminated sulfur increases, all other things being equal, when the pressure increases.
Figure 11:
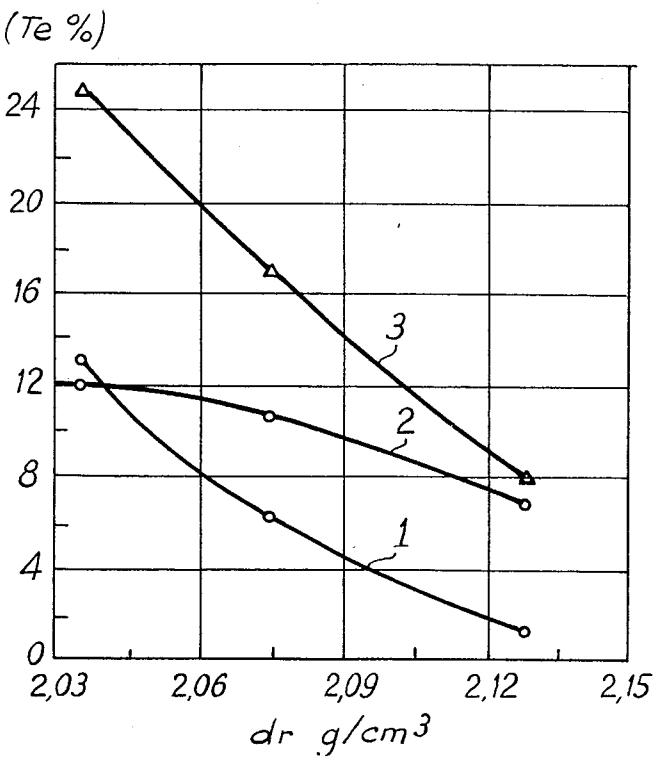

FIG. 11 shows the influence of the real density dr (gr./c.c.) of a coke obtained according to the invention process on the content in asphaltenes and carboids (Te%) of a pitch having been used for the impregnation of the treated sulfurized green coke. Curve 1 refers to content in carboids, curve 3 to the content in asphaltenes and curve 3 to content in both carboids and asphaltenes.

Figure 13:
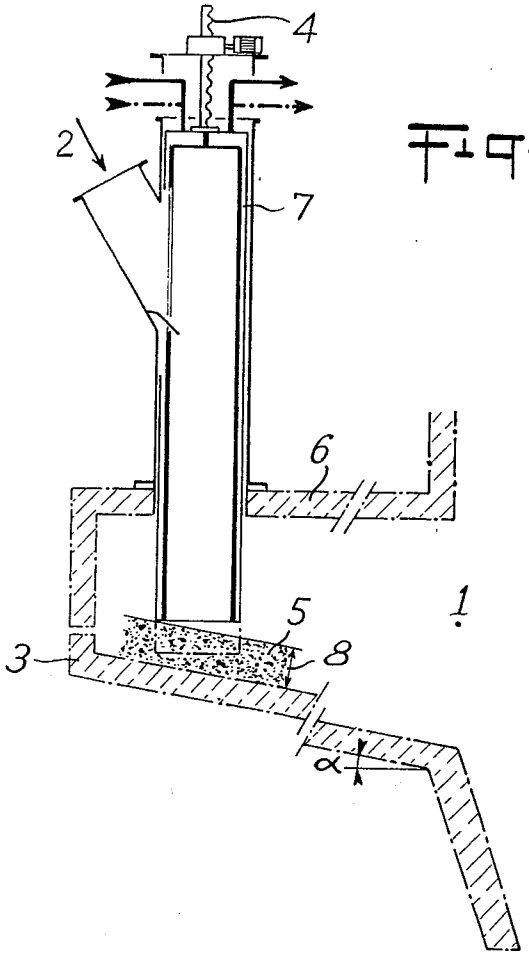

FIG. 13 shows a diagram of a device for suitable control of the green coke bed height in a rotary-hearth calcination furnace. On this figure (showing in cross-section only a part of the device) we see at:

1 the desulfurizing calcination furnace
2 the intake of green coke
3 the rotary hearth inclined with respect to the horizontal by angle $\alpha$
4 the adjustment rack of feed tube position
5 the coke bed
6 the upper fixed crown of the furnace
7 the movable part of the feed tube, driven by the rack, imparting to the coke bed a given height H.

Figure 14:
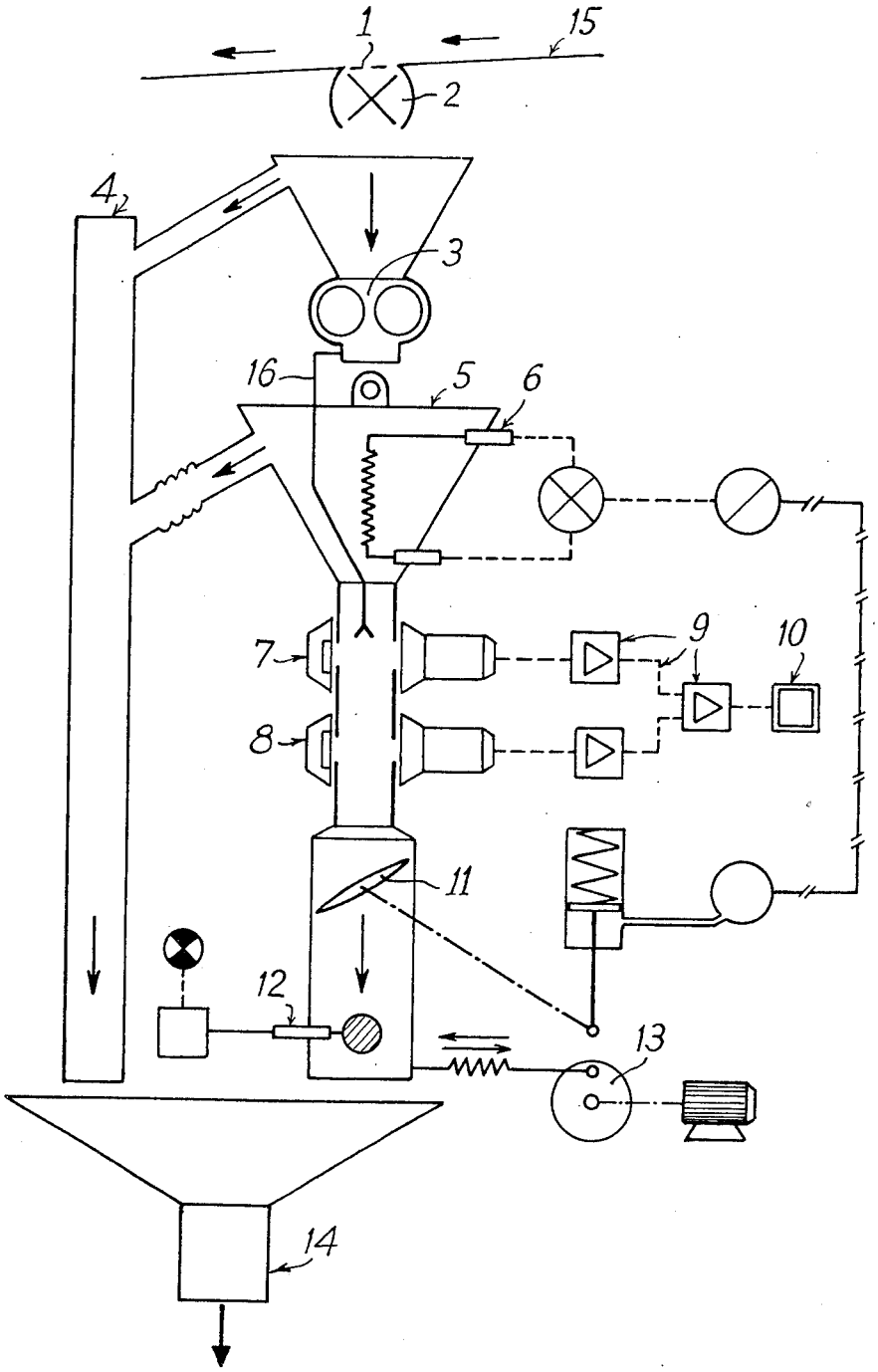

FIG. 14 shows the diagram of a device for continuous analysis of the coke during treatment. The coke is taken in the furnace and brought by a junction spout 15 up to a screen 1, under which is a rotary valve 2 driven by a motor. The coke falls into a hopper at the bottom of which is a micro-grinder 3. The excess of coke is evacuated by a spout 4. The ground coke fills hopper 5 and the inspection chamber, located immediately above the hopper. A level device 6 controls the filling of hopper 5. An oscillating device 16 permits suitable settling of the coke. The assembly 7, 8, 9 and 10 show schematically two devices for measuring coke properties, viz, the sulfur content and density. 11 shows a butterfly valve the drive of which is connected to the coke level detection device in hopper 5. 12 is a coke flow controller, mounted in a vibrating device 13. 14 is the coke evacuation hopper.

A non-limitative example of using the invention is given hereafter:

For raw coke one uses an oil coke with mean particle size distribution on the order of 15 to 25 mm., including 10% of volatile matter, with density of 1 gr./c.c. and which contains 6.2% of S by weight. This green coke comes from delayed cokefaction of oil products originating in the Middle East.

Figure 12:
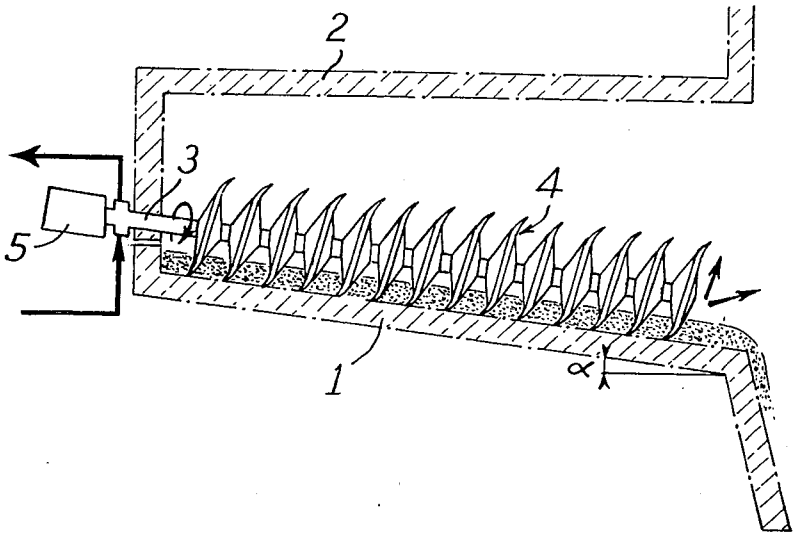
FIG. 12 shows a device according to the invention to ensure the mixing and homogenization of a coke bed during treatment, according to the invention. On this partial cross-section of an inclined rotary hearth furnace equipped with a worm screw, according to the invention, we see.

This green coke is introduced into an inclined-hearth furnace, which is equipped with two devices for mixing coke particles, like the one described in FIG. 12.

Various tests were performed, with periodic controls of all the coke time periods during treatment. The coke samples (cf. FIG. 14) inspected weight about 20 gr. each. Thanks to these controls, the temperature inside the furnace was adjusted at 1500°C and the coke treatment duration at 3 hours.

The coke obtained had:
a sulfur percentage of 1%
a density of 2.02 gr./c.c.
a content in volatile matter of 0.7%
an electric resistivity of 560 ohms/sq.mm./m. with a metal oxide content of $\leq$ 0.13%.

I claim:

1. A process of producing electrode-grade carbon from green coke having a sulfur content higher than 3% by weight, said process comprising subjecting said coke to a desulfurizing calcination treatment under a reducing atmosphere at a temperature of 1,400° – 1,700° C. and within the temperature range at which the density of the coke decreases as the temperature increases, said treatment being conducted at least until the content of sulfur in the coke is reduced to 1.2% by weight, but at a sufficiently slow rate of coke crystallization to form open pores in the coke, thereby permitting sulfurized compounds to escape from the coke, controlling said process during said treatment by continuously sampling and measuring the following parameters:
a. coke sulfur content
b. coke graphitization
c. coke pore structure
d. coke density, and
adjusting operation conditions in response to said parameters to yield the desired properties of the resultant coke.

2. A process according to claim 1, wherein the sulfur content of the coke is determined by continuous measurement of flue gas output and of the composition of gaseous sulfurized products.

3. A process according to claim 1, wherein the measurement of the sulfur content of coke is determined by gamma or X-ray radiation on said samples.

4. A process according to claim 3, wherein the sulfur content of the coke is measured by activating coke powder with gamma rays from Americum 241 and detecting and measuring resultant fluorescence by amplified scintillation, the measuring accuracy being within 100 ppm of sulfur in the coke.

5. A process according to claim 1, wherein the coke structure is controlled continuously and in place by means of a couple of electric electrodes immersed in the bed of coke being treated and measuring the electric resistivity of said bed.

6. A process according to claim 1, wherein the coke structure is contolled by measurement by means of gamma or X-ray radiation passed through the bed of coke being formed.

7. A process according to claim 1, wherein the green coke is subjected before treatment to at least partial impregnation by a pitch rich in carbon and poor in sulfur, to create a reducing atmosphere during the desulfurizing calcination.

8. A process according to claim 7, wherein the pitch contains 8 – 24% by weight of carboid and asphaltene.

9. A process according to claim 1, wherein there is added to the green coke a graphitization accelerator.

10. A process according to claim 9, wherein said graphitization accelerator is C, Si, Al, Ni, Ca, or Ti.

11. A process according to claim 1, wherein the desulfurizing calcination is effected under a pressure of 1 to 7 atmospheres.

12. A process according to claim 1, wherein there is added to the green coke a graphitization slowing-down agent.

13. A process according to claims 12, wherein the slowing-down agent is S, Cr, Se, or Mo.

14. A process according to claim 1, wherein the treatment time is at least about 3 hours.

15. A process according to claim 1, said green coke prior to said desulfurizing calcination treatment having been impregnated at least partially with a pitch rich in carbon and poor in sulfur to create a reducing atmosphere during the desulfurizing calcination, said green coke further containing a graphitization accelerator.

* * * * *